United States Patent [19]

Wallussek et al.

[11] 4,407,374

[45] Oct. 4, 1983

[54] DEVICE FOR CONTROLLING THE ORIENTATION OF BORE HOLES

[75] Inventors: Heinz Wallussek, Herdecke; Martin Wiebe, Hattingen; Thomas Röder, Herne, all of Fed. Rep. of Germany

[73] Assignee: Bergwerksverband GmbH, Essen, Fed. Rep. of Germany

[21] Appl. No.: 230,591

[22] Filed: Feb. 2, 1981

[30] Foreign Application Priority Data

Dec. 6, 1980 [DE] Fed. Rep. of Germany ..... 3046122

[51] Int. Cl.[3] ..... E21B 7/08

[52] U.S. Cl. ..... 175/24; 175/45; 175/61; 175/73

[58] Field of Search ..... 175/24, 45, 73, 76, 175/61, 78, 325

[56] References Cited

U.S. PATENT DOCUMENTS

| | | | |
|---|---|---|---|
| 3,243,001 | 3/1966 | Vincent | 175/73 |
| 3,841,420 | 10/1974 | Russell | 175/73 X |
| 3,853,186 | 12/1974 | Dahl et al. | 175/24 X |
| 4,026,371 | 5/1977 | Takada et al. | 175/73 X |
| 4,040,494 | 8/1977 | Kellner | 175/73 X |

*Primary Examiner*—Stephen J. Novosad
*Attorney, Agent, or Firm*—Michael J. Striker

[57] ABSTRACT

A device for controlling the inclination of underground bore holes is in form of a drill guide rod having an outer element and an inner element which rotates coaxially in the outer element. Gib-shaped members can be pivoted out from the outer element in the same manner as the ribs of an umbrella, and electrical inclinometers in the rod furnish the signals which control the time and degree of such pivoting.

18 Claims, 3 Drawing Figures

8
2
9
22
6
10
11
17
23
4
19
18
3
16
20
14
9
12
13
7
1
15

DEVICE FOR CONTROLLING THE ORIENTATION OF BORE HOLES

BACKGROUND OF THE INVENTION

This invention relates to the field of drilling.

More particularly, the invention concerns a device for controlling the orientation of bore holes.

In many instances, particularly in mining operations, it is highly desirable and sometimes vital, to be able to drive a bore hole as close as possible to the intended spot. For example, this is evidently desirable when the bore hole is being driven to gain access to a new underground area of coal or another substance to be mined. On the other hand, the ability to be able to drive a bore hole directly to a chosen spot may become a matter of life and death if one or more workers are trapped underground and the bore hole is being driven to either supply them with air, food and/or medicine, or else to physically remove them to safety through the bore hole.

The problem with the prior art is that it is not effective.

It is known to incorporate in the drill string a rigid guide rod which is located behind the drill bit and is intended to stabilize the drill string, which it does in fact do. Such guide rods cannot, however, prevent a deviation of the bore hole from its intended path, as it occurs during the course of drilling. Even less, of course, can these rods correct such a deviation once it occurs. And finally, if a deviation does occur no one will know of its details until the drill target is or should be reached and it is found that the bore hole does not come out where intended.

A proposal has been made to provide these guide rods with pendulum controls to cause them to more or less automatically maintain the bore hole "on target". Such controls are, however, quite complicated and expensive. Moreover, they are susceptible to malfunctions due to errors in setting or operating malfunctions in the control itself. This will then again lead to bore-hole deviations which can be detected only when the drilling operation is completed and it is discovered that the bore hole does not come out where intended. Also, these controls have a certain inertia factor which in itself may give rise to bore hole deviations.

SUMMARY OF THE INVENTION

It is an object of the invention to overcome the disadvantages of the prior art.

A more particular object is to provide an improved device for controlling the orientation of bore holes.

A concomitant object is to provide a device of the type under discussion which permits not only control (i.e., monitoring) of the bore hole orientation, but the correction of any deviations which may be occurring.

In keeping with these and other objects, one aspect of the invention resides in a device of the type under discussion which includes a drill guide rod including an outer fixed part, an inner part turnable relative to the outer fixed part, electrically operating inclinometers on or in the outer part, and adjustable orientation-correcting elements on the outer part.

A device according to the invention permits constant monitoring of the bore hole orientation via the inclinometers and, if deviation of the bore hole from the prescribed path is detected, the execution of appropriate corrections via the correcting elements. These can be extending outwardly from the outer part of different selectable distances, in dependence upon the degree and direction of detected bore hole deviation. A monitoring cable may extend from the inclinometers through the drill string to the control panel or stand of the drilling machine, so that the inclinometer signal can be monitored at the stand and appropriate counter-measures taken from there. Monitoring and correcting is advantageously carried out step wise in the drill pauses because vibrations and other error sources are then excluded. However, both functions can also be carried out while drilling is in progress.

It is advantageous for the correcting elements to be mounted at the head of the guide rod and to be pivotable outwardly from the same via hydraulic cylinders mounted in the upper part of the rod. In this manner the correcting elements can be moved from the rod in the same pattern in which the ribs of an umbrella move away from its stem when the umbrella opens. Moreover, even the slightest movement of the cylinders will be reflected by a corresponding movement of the correcting elements, and the parts needed for effecting and controlling this movement can be positioned in such a manner as to be largely protected against contamination and/or damage.

The inclinometers may have magnetic (solenoid) valves associated with them and these valves will then control the supply of hydraulic fluid to the cylinders. The valves may be so set that they effect movements of the correcting elements which are analogous to the signals received from the inclinometers.

Erroneous measurements can be avoided and better results obtained if the inclinometers are arranged crosswise. This permits erroneous indications to be readily detected at the control panel and to be negated by appropriate countermeasures.

It is advantageous if the required hydraulic operating pressure is produced directly in the rod. For this purpose the inner turnable part of the rod may carry an eccentric via which the requisite operating pressure is produced. Pressure-limited hydraulic accumulators may be connected between the pressure generator and the cylinders so that hydraulic actuation of the cylinders is possible even during pauses in the drilling activity.

To avoid the need for having to run an electric supply cable through the drill string, and to permit the generation of an adequate supply voltage in the guide rod itself, it is advantageous to mount a gear on the shaft of a generator which is connected with the outer stationary rod part, and to have this gear mesh with a second gear which is provided on the inner rotatable part of the rod. A shrink fitting of the gear onto the inner rod is advisable to avoid slippage. To avoid projecting parts it is advantageous to arrange the generator within the outer stationary part of the rod.

According to a further embodiment of the invention the inner wall of the outer stationary part of the rod may be constructed as the stator, and the surface of the turnable inner part as the rotor of the generator. The stator is preferably constituted by a tubular sleeve which is rigidly connected with the stationary outer part, and the rotor by permanent magnets which are fixedly connected with the turnable inner part. This embodiment requires very little space and is therefore especially well suited for the intended applications.

The novel features which are considered as characteristic for the invention are set forth in particular in the appended claims. The invention itself, however, both as to its constructions and its method of operation, together with additional objects and advantages thereof, will be best understood from the following description of specific embodiments when read in connection with the accompanying drawing.

DESCRIPTION OF THE PREFERRED EMBODIMENTS

Figure 1:
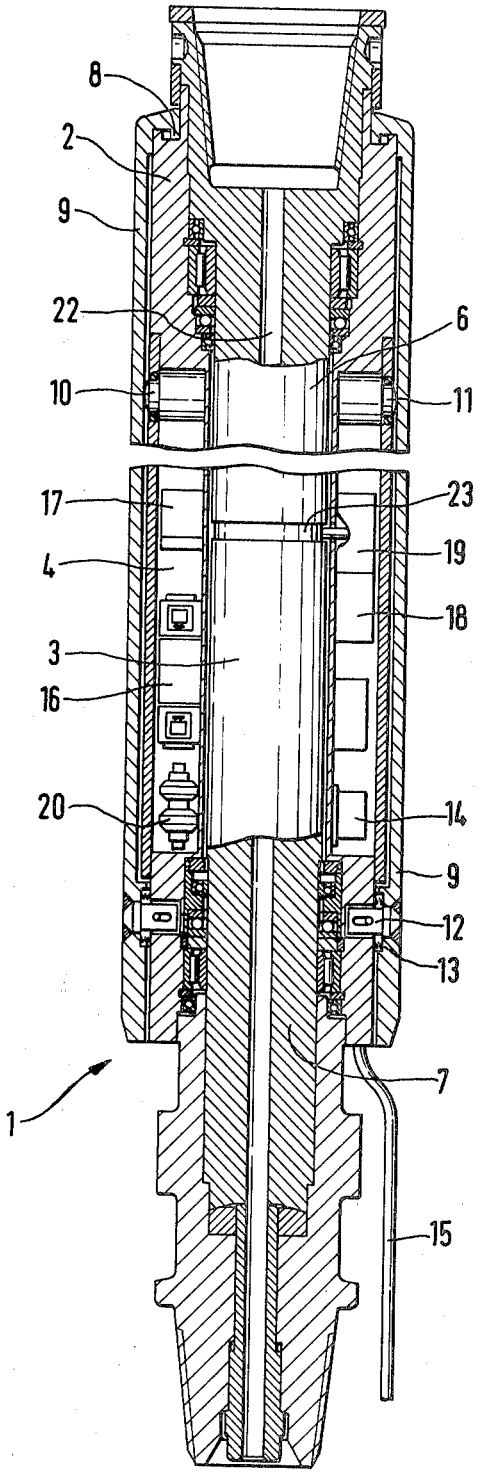
FIG. 1 is a device according to the invention, shown in axial section.

The device illustrated in FIG. 1 is a drill guide rod 1 to be incorporated in a drill string behind the drill bit. It has a rotary inner part 3 and a stationary outer part 4. A flushing passage 22 extends through the center of rod 1, for supply of drilling fluid to the not illustrated drill bit.

Rod 1 has a head portion 2 and a plurality of angularly spaced (only two visible) bore hole orientation correcting elements 9 which are firmly connected to part 4 at the head portion 2, by means of mounts which allow the lower ends (adjacent end portion 7 of rod 1) of the elements 9 to tilt outwardly away from the rod 1. Hydraulic cylinders 10, 11 are mounted in the upper part of rod 1 which when extended, pivot the elements 9 outwardly away from part 4. Limiters 12 prevent movement of the elements 9 outwardly from rod 1 beyond a predetermined extent. Springs 13 associated with the limiters return the elements 9 to their (illustrated) starting position when the cylinders 10, 11 are not supplied with hydraulic fluid.

The operation of cylinders 10, 11 is controlled by magnetic (solenoid) valves 16, 17 (known per se) which control the flow of fluid to and from the cylinders. The valves are in turn controlled by signals received from electrically operated inclinometers 14 (known per se). In addition to furnishing their signals to the valves 16, 17 the inclinometers also supply the signals (via an appropriate cable or in another suitable manner) to the drilling machine control panel.

The hydraulic operating pressure required for the hydraulic control is produced by the rotating part 3 of the rod 1, in the illustrated embodiment by an eccentric 23 which is provided thereon. Pressure-limited hydraulic accumulators 20 are provided which permit the cylinders 10, 11 to operate during pauses in the drilling operation; the required fluid is then withdrawn from reservoir 18 via pressure generator 19.

In the embodiment of FIG. 1 the electric energy for the inclinometers 14 and the valves 16, 17 is supplied via the cable 15 which also functions as the monitoring and control cable. The inclinometers 14 may be directly coupled with the cylinders 10, 11 but in that case a sight control of the bore hole path from the control panel is not possible without additional equipment.

Figure 2:
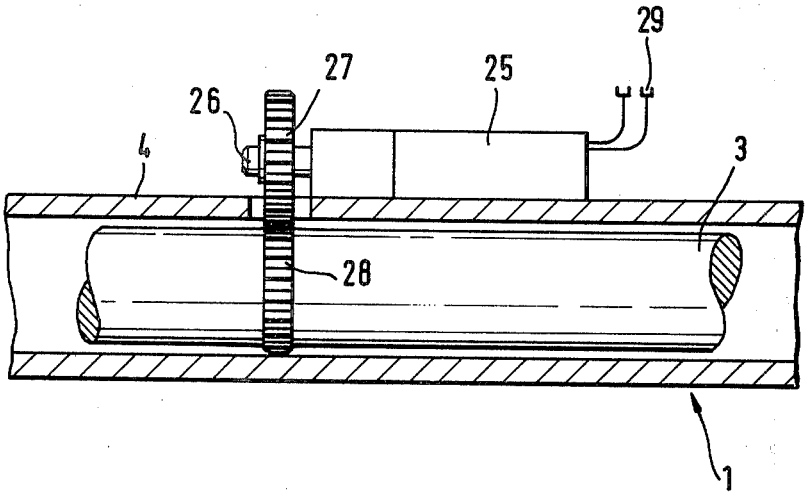
FIG. 2 is a fragmentary axial sectional view of another embodiment of the invention.

In the embodiment of FIG. 2 the inclinometers and valves 16, 17 are supplied with electricity which is generated in situ. For this purpose a generator 25 is provided which, for the sake of simplicity, may be mounted on the outer stationary part 4 of rod 1. It has an input shaft 26 carrying a gear 27 which meshes with another gear 28 on the rotary inner part 3 of rod 1. Gear 28 may be shrunk onto the inner part 3, or it may be directly formed in the material of part 3 to keep from subjecting part 3 to additional external forces. Taps 29 on the housing of the generator 25 furnish the supply voltage for elements 14, 16 and 17.

Figure 3:
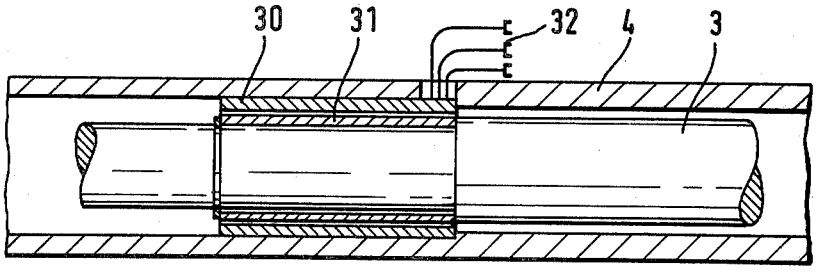
FIG. 3 is a view similar to FIG. 2 but showing still another embodiment.

In the embodiment of FIG. 3, finally, the generator is so constructed as to require no projecting parts at all. Its stator 30 is formed by a tubular sleeve which is firmly connected with the stationary part 4. The rotor 31 is formed by permanent magnets which are connected for rotation with the inner part 3. The supply voltage is tapped off the terminals 32.

A particular advantage of the present invention results from the fact that any deviation of a bore hole can be easily determined and corrected by appropriate countermeasures. The additional expenses and time losses associated with deviating bore holes are thus avoided, to say nothing of the consequences for health and life of trapped personnel. The correction can even be effected automatically and everything can be monitored and supervised from the drilling machine control panel. If, as in the embodiments of FIGS. 2 and 3, the supply voltage for the electrical equipment is generated in the device itself, then such generation can be effected without the need for supplying additional energy.

While the invention has been illustrated and described as embodied in a bore-hole monitoring and correcting device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Device for controlling the orientation of bore holes, particularly in underground coal mining applications, comprising a drill guide rod adapted to be included in a drill string rearwardly of the drill bit and including an outer elongated element and an inner elongated element coaxial with and turnable in said outer element; inclinometer means on at least one of said elements and operative for generating signals when inclination of said rod indicates deviation from a predetermined bore hole path; pivotably adjustable correcting means including a plurality of gib-shaped correcting members pivotally mounted on said outer element; a plurality of cylinder-and-piston units arranged for engaging said members and pivoting them outwardly away from said outer element to a selectable extent; a generator to be driven by said inner element; and magnetic valves supplied from said generator and controlled by signals received from said inclinometer means to thereby control the operation of said cylinder-and-piston units so as to pivot said gib-shaped correcting members.

2. Device as defined in claim 1, said inclinometer means comprising a plurality of electrically operated inclinometers.

3. Device as defined in claim 2, said inclinometers being arranged crosswise with reference to a crosssection of said guide rod.

4. Device as defined in claim 1, said members being movable to and arrestable in a plurality of positions relative to said outer element.

5. Device as defined in claim 4, said guide rod having a head portion and a body portion longitudinally spaced from said head portion, and said members being pivotably mounted on said head portion and extending lengthwise of said rod.

6. Device as defined in claim 5, said cylinder-and-piston units including hydraulic fluid lines, said magnetic valves being provided in said fluid lines and operatively connected to said inclinometers to control the flow of hydraulic fluid to and from said units in response to signals generated by said inclinometers.

7. Device as defined in claim 5; further comprising pressure-generating means in said guide rod and operative for pressurizing the hydraulic fluid for said cylinder-and-piston units; and further comprising pressure-limited hydraulic accumulators interposed between and connected with said pressure-generating means and said cylinder-and-piston units.

8. Device as defined in claim 1, and further comprising an eccentric mounted on said turnable inner element of said guide rod.

9. Device as defined in claim 1; and further comprising storage batteries in said guide rod and electrically connected with said generator to be charged by the same.

10. Device as defined in claim 1, said generator having a drive shaft carrying a first gear, and said inner element having a second gear which rotates with it and which meshes with said first gear so as to turn said drive shaft.

11. Device as defined in claim 10, said inner element being adapted to be connected to and rotate with the drill string, and said second gear surrounding said inner element and being shrink-fitted onto the same.

12. Device as defined in claim 1, wherein said generator is located within said outer element.

13. Device as defined in claim 1, wherein said generator including a stator constituted by an inner circumferential surface of said outer element, and a rotor constituted by an outer circumferential surface of said inner element.

14. Device as defined in claim 13, said outer element including an inserted tubular sleeve rigidly connected therewith and having said inner circumferential surface, and said inner element including a plurality of permanent magnets rigidly connected with said inner elements and together having said outer circumferential surface.

15. Device for controlling the orientation of bore holes, particularly in underground coal mining applications, comprising a drill guide rod adapted to be included in a drill string rearwardly of the drill bit and including an outer elongated element and an inner elongated element coaxial with and turnable in said outer element; inclinometer means on at least one of said elements and operative for generating signals when inclination of said rod indicates deviation from a predetermined bore hole path, said inclinometer means including a plurality of electrically operated inclinometers; and pivotably adjustable correcting means on one of said elements and operative for correcting the deviation indicated by said signals.

16. Device for controlling the orientation of bore holes, particularly in underground coal mining applications, comprising a drill guide rod adapted to be included in a drill string rearwardly of the drill bit and including an outer elongated element and an inner elongated element coaxial with and turnable in said outer element; inclinometer means on at least one of said elements and operative for generating signals when inclination of said rod indicates deviation from a predetermined bore hole path; pivotably adjustable correcting means on one of said elements and operative for correcting the deviation indicated by said signals; and an eccentric mounted on said turnable inner element of said guide rod.

17. Device for controlling the orientation of bore holes, particularly in underground coal mining applications, comprising a drill guide rod adapted to be included in a drill string rearwardly of the drill bit and including an outer elongated element and an inner elongated element coaxial with and turnable in said outer element; inclinometer means on at least one of said elements and operative for generating signals when inclination of said rod indicates deviation from a predetermined bore hole path; pivotably adjustable correcting means on one of said elements and operative for correcting the deviation indicated by said signals; and a generator on said outer element and operative to be driven by rotation of said inner element.

18. Device for controlling the orientation of bore holes, particularly in underground coal mining applications, comprising a drill guide rod adapted to be included in a drill string rearwardly of the drill bit and including an outer elongated element and an inner elongated element coaxial with and turnable in said outer element; inclinometer means on at least one of said elements and operative for generating signals when inclination of said rod indicates deviation from a predetermined bore hole path; pivotably adjustable correcting means on one of said elements and operative for correcting the deviation indicated by said signals; and an electrical generator including a stator constituted by an inner circumferential surface of said outer element, and a rotor constituted by an outer circumferential surface of said inner element.

* * * * *